United States Patent [19]

Berger

[11] Patent Number: 5,030,063

[45] Date of Patent: Jul. 9, 1991

[54] TURBOMACHINE ROTOR

[75] Inventor: Jeffrey L. Berger, Indianapolis, Ind.

[73] Assignee: General Motors Corporation, Detroit, Mich.

[21] Appl. No.: 476,852

[22] Filed: Feb. 8, 1990

[51] Int. Cl.[5] ..... F01D 5/32

[52] U.S. Cl. ..... 416/220 R

[58] Field of Search ..... 416/193 A, 219 R, 220 R, 416/248

[56] References Cited

U.S. PATENT DOCUMENTS

| | | | |
|---|---|---|---|
| 2,656,146 | 10/1953 | Sollinger | 416/248 X |
| 2,802,619 | 8/1957 | Clarke | 230/134 |
| 2,819,870 | 1/1958 | Wayne | 416/248 |
| 2,875,948 | 3/1959 | Stalker | 416/220 R |
| 2,988,325 | 6/1961 | Dawson | 416/220 R |
| 3,245,657 | 4/1966 | Cooper et al. | 416/220 R X |
| 3,356,340 | 12/1967 | Bobo | 416/220 R X |
| 3,455,537 | 7/1969 | Kozlin et al. | 416/220 R X |
| 3,556,675 | 1/1971 | Howald et al. | 416/190 |
| 3,734,646 | 5/1973 | Perkins | 416/220 R |
| 3,768,924 | 10/1973 | Corsmeier et al. | 416/220 R X |
| 3,801,222 | 4/1974 | Violette | 416/222 |
| 3,936,222 | 2/1976 | Asplund et al. | 416/193 A X |
| 3,957,393 | 5/1976 | Bandurick | 416/220 R |
| 4,033,705 | 7/1977 | Luebering | 416/220 R |
| 4,344,740 | 8/1982 | Trenschel et al. | 416/193 A X |
| 4,621,979 | 11/1986 | Zipps et al. | 416/219 |
| 4,655,687 | 4/1987 | Atkinson | 416/193 |
| 4,802,824 | 2/1989 | Gastebois et al. | 416/193 |

FOREIGN PATENT DOCUMENTS

| | | | |
|---|---|---|---|
| 2908242 | 9/1979 | Fed. Rep. of Germany | 416/220 R |
| 2514409 | 4/1983 | France | 416/193 A |
| 2006883 | 5/1979 | United Kingdom | 416/220 R |

*Primary Examiner*—Edward K. Look
*Assistant Examiner*—James A. Larson
*Attorney, Agent, or Firm*—Saul Schwartz

[57] ABSTRACT

A rotor for an axial flow turbomachine includes a disc, a rim on the disc having blade retention slots, and blades having roots in the slots and airfoils extending radially out from the rim. The airfoils project through correspondingly shaped slots in a cylindrical platform concentric with the rim of the rotor. A first annular flange at one end of the platform has a lip at its inside diameter which hooks under the inside diameter of a first annular flange on the rim for radial retention of the platform. A second annular flange at the other edge of the platform has a lip at its inside diameter which hooks under a lip at the outside diameter of an annular cover. The cover has another lip at its inside diameter which hooks under a second annular flange on the rim for radial retention of the cover and the platform.

7 Claims, 2 Drawing Sheets

TURBOMACHINE ROTOR

FIELD OF THE INVENTION

This invention relates to blade platforms on turbomachine rotors.

BACKGROUND OF THE INVENTION

Rotor blades in axial flow compressors and turbines in gas turbine engines commonly have firtree roots retained in correspondingly shaped slots in a rim of a disc. The blades typically have integral platforms which butt together when the blades are assembled on the disc to define a cylindrical inner wall of an annular gas flow path. Stresses induced by high rotor speeds concentrate at the firtree slots and may be minimized by minimizing the mass of the blades. To that end, rotors have been proposed wherein the blades include only airfoils and roots, the platforms being separately attached structural elements. In one proposal, individual platforms are hinged to the disc between the airfoils. In another proposal, the platforms are inserts which fit around the airfoils and are retained by hooked portions which lodge in the slots at opposite ends of the blade roots. In still another proposal, individual T-shaped platforms are disposed between the airfoils and retained in slots in the disc between the blade retention slots. And in yet another proposal, individual platforms between the airfoils have wedge shaped ends which fit into the blade retention slots along side the blade roots. In a related proposal for a light-weight rotor, a pair of annular side plates on a shaft are welded together on opposite sides of discs from which sheet metal blades are formed, the blades projecting radially out through slots in a rim formed by the welded-together end plates. A turbomachine rotor according to this invention has a platform separate from the rotor blades which is simple to assemble on the rim of the rotor disc and which is attached to the rim remote from the most highly stressed regions thereof.

SUMMARY OF THE INVENTION

This invention is a new and improved rotor for an axial flow compressor or turbine in a gas turbine engine, the rotor being of the general type including a disc with an integral annular rim and a plurality of blades each having an airfoil and a firtree root received in a correspondingly shaped slot in the rim. In a preferred embodiment, the rotor according to this invention further includes a ring having a cylindrical platform perforated by a plurality of airfoil-shaped slots, an annular long flange on one side of the platform, and an annular short flange on the other side of the platform. The blades are assembled into the slots in the platform from inside the ring and the short flange of the ring is slid over the outside diameter of the rim until the long flange butts against the side of the rim and hooks under and inside diameter thereof, the individual blade roots concurrently sliding into corresponding ones of the blade retention slots. An annular cover hooks over the short flange of the ring and under and inside diameter of the rim. The long flange of the ring and the cover are bolted to the rim.

DESCRIPTION OF PREFERRED EMBODIMENT

Figure 1:
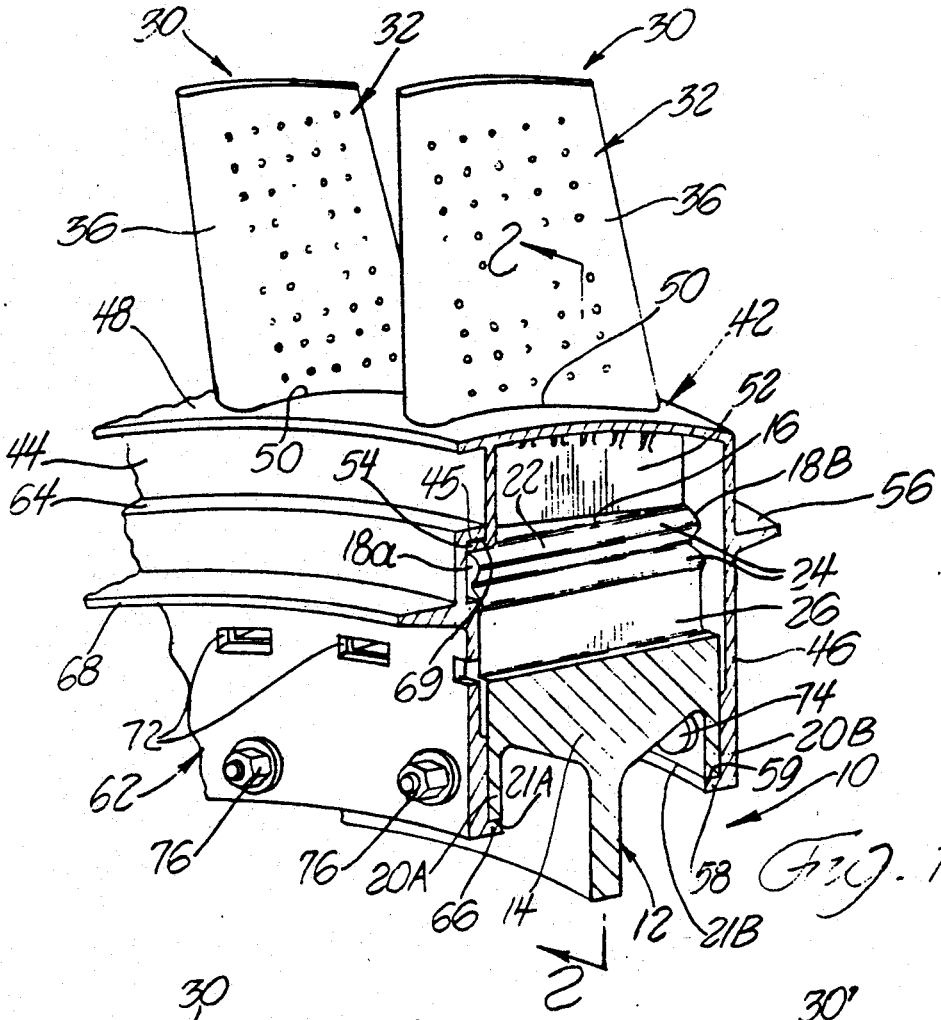
FIG. 1 is a fragmentary perspective view of a gas turbine engine rotor according to this invention.
Figure 2:
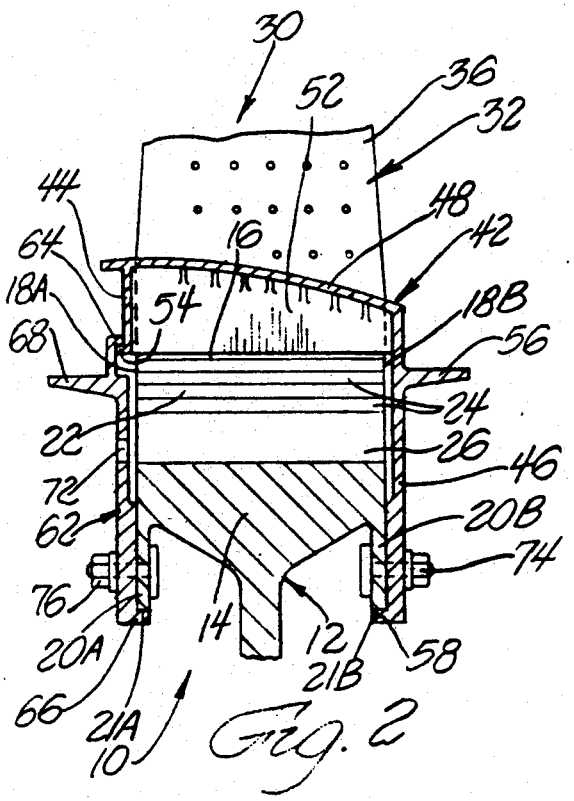
FIG. 2 is a view taken generally along the plane indicated by lines 2—2 in FIG. 1.
Figure 3:
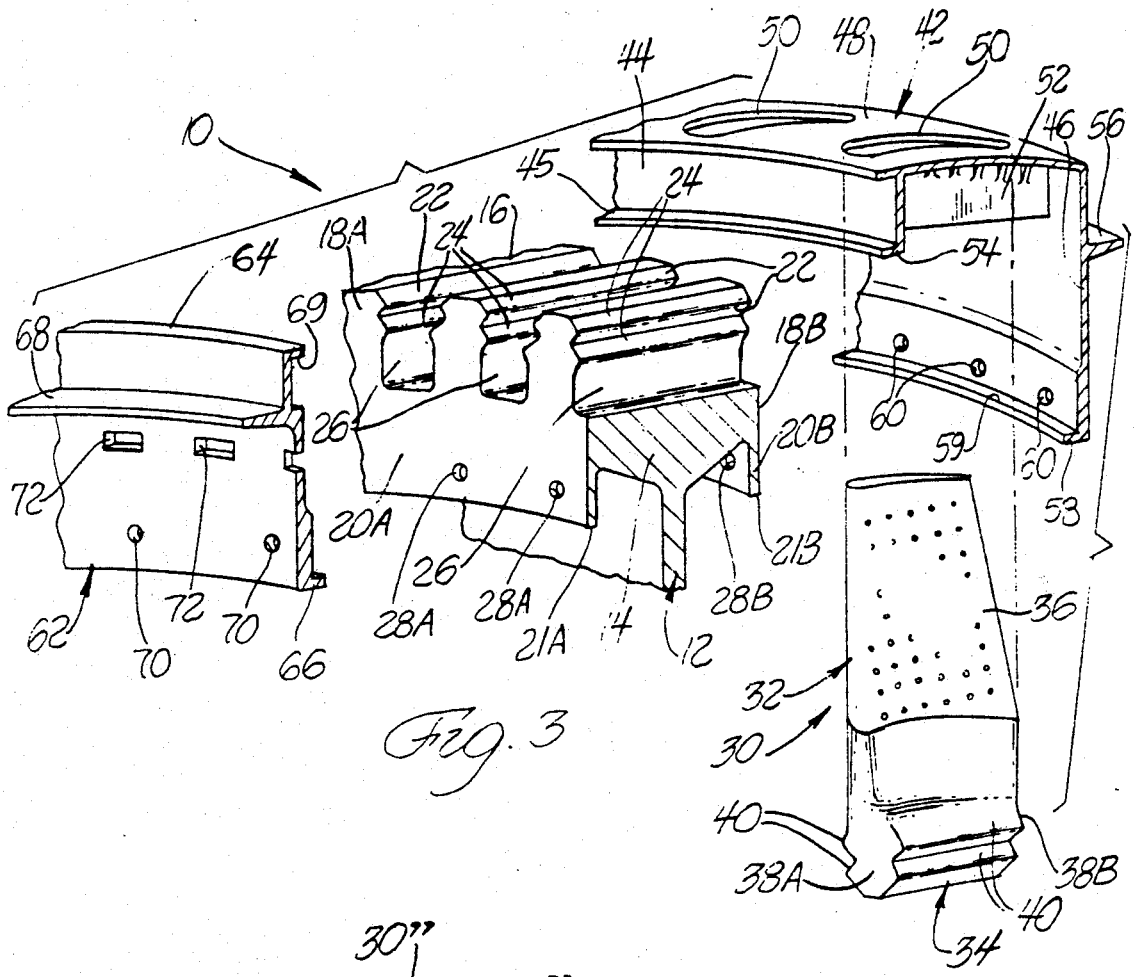
FIG. 3 is an exploded perspective view of the rotor according to this invention illustrated in FIG. 1.

Referring to FIGS. 1-3, a gas turbine engine turbine rotor 10 according to this invention includes a disc 12 having an integral annular rim 14. The rim 14 has a cylindrical outside wall 16, a pair of side walls 18A-B on opposite sides of the rim in planes parallel to the plane of the disc, and a pair of integral annular flanges 20A-B generally in the planes of the side walls 18A-B, respectively. The inside diameters of the flanges 20A-B define a pair of radially inwardly facing cylindrical surfaces 21A-B, FIG. 3.

As seen best in FIG. 3, a plurality of circumferentially spaced firtree slots 22 in the rim 14 open through both side walls 18A-B and through the outside wall 16. Each firtree slot has a plurality of retention and sealing lands 24 on opposite sides thereof and a manifold 26 at the radially innermost extremity thereof. The flanges 20A-B have a plurality of bolt holes 28A-B, respectively, therein.

The turbine rotor 10 further includes a plurality of turbine blades 30 each having an airfoil 32 and an integral firtree root 34. Each airfoil 32 has a porous skin 36 for transpiration cooling and a spar, not shown, supporting the skin and having passages for conducting coolant to the backside of the skin. Each firtree root 34 has a pair of planar ends 38 A-B and a plurality of retention lands 40. The roots 34 merge directly with the airfoils 32.

The roots 34 are received in respective ones of the firtree slots 22 in the rim 14. The lands 40 on the roots 34 fit between the lands 24 on the rim for blade retention and for pressure sealing the manifolds. The coolant passages in the spars of the blades extend through the roots 34 to corresponding ones of the manifolds for conducting coolant from the manifolds to the backsides of the porous skins 36.

A ring 42 of the turbine rotor 10 surrounds the rim 14 and includes an annular short flange 44 and an annular long flange 46 integral with and on opposite sides of a cylindrical platform 48. The platform 48 has a plurality of airfoil-shaped slots 50 therein which closely receive corresponding ones of the airfoils 32 of the blades 30. The platform 48 is reinforced by a plurality of ribs between the slots 50 welded to or cast integrally with the platform and each of the short and long flanges 44,46, only a single rib 52 being illustrated in FIGS. 1 and 3.

As seen best in FIGS. 1-2, the short flange 44 extends radially in from the platform 48 to where the firtree roots 34 begin on the blades 30. The short flange 44 has an out-turned lip 54 around its inside diameter the upper side of which defines a radially outwardly exposed surface 45, FIG. 3. The long flange 46 extends radially in from the platform 48 to about the inside diameter of the flange 20B on the rim 14 and covers the ends of the firtree slots 22 opening through the side wall 18B of the rim. The long flange has an annular seal land 56 on one side and an in-turned lip 58 around its inside diameter.

The upper side of lip 58 defines a radially outwardly exposed surface 59 which hooks under the flange 20B on the rim. The long flange 46 has a plurality of bolt holes 60, FIG. 3, spaced in accordance with the spacing between the bolt holes 28B in the flange 20B.

The rotor 10 further includes an annular cover 62 on the opposite side of the ring 42 from the long flange 46. The cover 62 has a first lip 64 around its outside diameter, a second lip 66 around its inside diameter, and a seal land 68 extending opposite the lips. The first lip 64 has a radially inwardly facing surface 69, FIG. 3, which engages the outwardly exposed surface 45 on the short flange 44 of the ring 42. The second lip 66 hooks under the cylindrical surface 21A on flange 20A. The cover 62 has a plurality of bolt holes 70, FIG. 3, spaced in accordance with the spacing between the bolt holes 28A in the flange 20A on the rim and a plurality of coolant ports 72 generally adjacent the manifolds 26 at the bottoms of the firtree slots 22.

The long flange 46 is bolted to the flange 20B on the rim 14 by a plurality of bolts 74 through registered pairs of the bolt holes 28B,60. The cover 62 is bolted to the flange 20A on the rim 14 by a plurality of bolts 76 through registered pairs of the bolt holes 28A,70. The long flange 46 is captured radially at the interface between cylindrical surfaces 21B,59. The cover 62 is captured radially at the interface between cylindrical surface 21A and the lip 66. The short flange 44 of the ring 42 is captured radially at the interface between cylindrical surfaces 45,69.

In assembling the rotor, the ring 42 and the cover 62 are positioned on opposite sides of the rim 14, FIG. 3. The airfoils 32 of the individual blades 30 are inserted through respective ones of the slots 50 in the platform 48 from inside the ring until the junctions between the airfoils and roots are about even with the inside diameter of the short flange 44 of the ring. The ring and the blades are then assembled on the rim 14 by sliding the short flange 44 over the outside wall 16 of the rim and each of the roots 34 into a corresponding one of the firtree slots 22 until the long flange 46 abuts the flange 20B on the rim. The cover 62 is positioned against the other flange 20A on the rim with lip 66 under the flange 20A and lip 64 over the lip on the short,flange 54. Bolts 74,76 hold the ring 42 and the cover 62 on the rim 14.

In operation, the platform 48 defines the radially inner boundary of a gas path between the airfoils 32 of the blades. Stationary seals, not shown, cooperate with the lands 56,68 in the usual fashion to minimize leakage of gas from the gas path. Coolant, usually compressed air, is circulated to the outside of the cover 62 radially inboard of the land 68 and migrates through the ports 72 to the manifolds 26 from which it is conducted to the backside of the porous skin 36 of each airfoil.

Importantly, the firtree slots 22 react only the loads induced by the airfoils 32 during rotation of the rotor so that stress concentrations at the slots is minimized. Loading induced by the platform 48 during rotation of the rotor is reacted to the rim 14 at the inside diameters of the flanges 20A–B which are less highly stressed regions of the rim than the slots 22.

Figure 4:
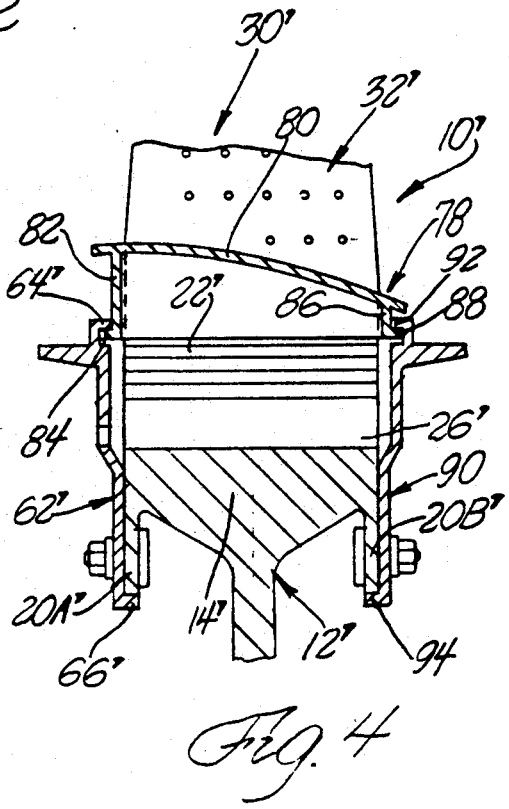
FIG. 4 is similar to FIG. 2 but illustrating a first modified embodiment of the rotor according to this invention.

Referring to FIG. 4, a first modified gas turbine engine turbine rotor 10' according to this invention includes a disc 12' and an integral rim 14' having a pair of flanges 20A'–B'. A ring 78 around the rim 14' includes a cylindrical platform 80 having a plurality of airfoil-shaped slots, not shown, each of which receives an airfoil 32' of a blade 30'. A firtree root, not shown, of each blade 30' is received in a firtree slot 22' in the rim and a manifold 26' is defined at the bottom of the slot below the root.

The ring 78 has a first flange 82 with a lip 84 at the inside diameter thereof corresponding to the flange 44 and lip 54 on the rotor 10 and a second flange 86 with a lip 88 at, the inside diameter thereof. A first cover 62' corresponding to the cover 62 on the rotor 10 is bolted to the rim 14' with a first lip 64' thereof over the lip 84 and a second lip 66' thereof under the flange 20A'. A second cover 90 is similarly bolted to the rim 14' on the opposite side from the cover 62' with a first lip 92 thereof over the lip 88 and a second lip 94 thereof under the flange 20B'.

The lips 66',94 on the covers 62',90 react rotation-induced loads of the platform to the rim 14' radially inboard of the firtree slots 22'. The rotor 10' is assembled as described above except that second cover 90 is bolted to the rim 14' after the ring 78 and the blades 30' are assembled on the rim.

Figure 5:
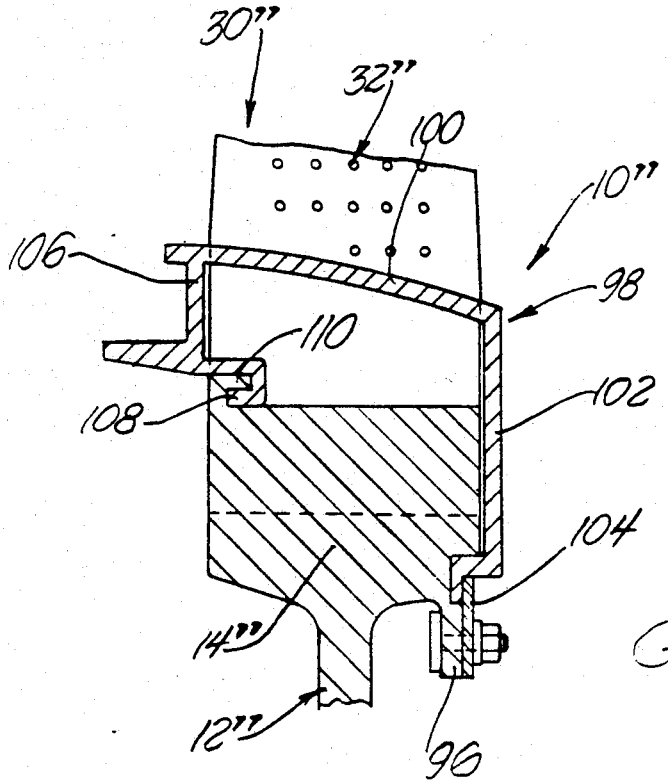
FIG. 5 is similar to FIG. 4 but illustrating a second modified embodiment of the rotor according to this invention.

Referring to FIG. 5, a second modified gas turbine engine turbine rotor 10'' according to this invention includes a disc 12'' and an integral rim 14'' having a single flange 96. A ring 98 around the rim 14'' includes a cylindrical platform 100 having a plurality of airfoil-shaped slots, not shown, each of which receives an airfoil 32'' of a blade 30''. A firtree root, not shown, of each blade is received in a firtree slot, not shown, in the rim.

The ring 98 has an integral long flange 102 on one side thereof captured by a retaining ring 104 bolted to the rim 14''. The ring 98 further includes a short flange 106 and a lip 108 which is located between the planes of the long and short flanges 102,106. The lip 108 is interrupted by slots, not shown, aligned with the airfoil-shaped slots in the platform 100. The rim 14'' has an integral, oppositely turned lip 110 which is likewise interrupted at each of the firtree slots in the rim. The lip 110 on the rim hooks over the lip 108 on the ring 98 for retention of the side of the ring opposite the long flange 102.

The embodiments of the invention in which an exclusive property or privilege is claimed are defined as follows:

1. In a turbomachine rotor including a disc, means defining an annular rim on said disc having a cylindrical outside wall between a pair of annular side walls, means defining a plurality of blade retaining slots in said rim opening through said outside wall and through each of said side walls, and a plurality of blades each having a root captured radially in one of said retaining slots between said side walls and an airfoil extending radially out from said cylindrical outside wall, the combination comprising:

a ring disposed around said rim including a cylindrical platform concentric with said cylindrical outside wall, means defining a plurality of airfoil-shaped slots in said platform each receiving a corresponding one of said blade airfoils, means defining a first annular flange extending radially in from a first edge of said platform, means defining a second annular flange extending radially in from a second edge of said platform, means defining on said first annular flange a first lip having a radially outwardly exposed surface at the inside diameter of said first annular flange, means defining on said second annular flange a second lip having a radially outwardly exposed surface at the inside diameter of said second annular flange, means on said rim defining a first radially inwardly facing cylindrical surface engaging said first lip on said radially outwardly exposed surface thereof for reacting rotation-induced loads from said ring to said rim, and means on said rim defining a second radially inwardly facing cylindrical surface engaging said second lip on said radially outwardly exposed surface thereof for reacting rotation-induced loads from said ring to said rim.

2. The turbomachine rotor recited in claim 1 wherein said means on said rim defining said first radially inwardly facing cylindrical surface includes a first annular flange on said rim generally in the plane of a first one of said pair of annular side walls and extending radially in from said rim to an inside diameter defining said first radially inwardly facing cylindrical surface.

3. The turbomachine rotor recited in claim 2 wherein said means on said rim defining said second radially inwardly facing cylindrical surface includes an annular cover having an inside diameter and an outside diameter, means rigidly attaching said cover to said rim at a second one of said pair of annular side walls with the outside diameter thereof radially overlapping the inside diameter of said second annular flange extending radially in from said second edge of said platform, and means on said cover defining a first lip at said outside diameter thereof having defined thereon said second radially inwardly facing cylindrical surface.

4. The turbomachine rotor recited in claim 3 wherein means rigidly attaching said cover to said rim includes a second annular flange on said rim generally in the plane of second one of said pair of annular side walls and extending radially in from said rim to an inside diameter, and means on said cover defining a lip at said inside diameter thereof engaging said inside diameter of said second annular flange on said rim.

5. The turbomachine rotor recited in claim 1 wherein said means on said rim defining said first radially inwardly facing cylindrical surface includes a first annular cover having an inside diameter and an outside diameter, means rigidly attaching said first cover to said rim at a first one of said pair of annular side walls with the outside diameter thereof radially overlapping the inside diameter of said first annular flange extending radially in from said first edge of said platform and means on said first cover defining a first lip at said outside diameter thereof and having defined thereon said first radially inwardly facing cylindrical surface, and said means on said rim defining said second radially inwardly facing cylindrical surface includes a second annular cover having an inside diameter and an outside diameter, means rigidly attaching said second cover to said rim at a second one of said pair of annular side walls with the outside diameter thereof radially overlapping the inside diameter of said second annular flange extending radially in from said second edge of said platform, and means on said second cover defining a first lip at said outside diameter thereof and having defined thereon said second radially inwardly facing cylindrical surface.

6. The turbomachine rotor recited in claim 5 wherein said means rigidly attaching said first cover to said rim includes a first annular flange on said rim generally in the plane of said first one of said pair of annular side walls and extending radially in from said rim to an inside diameter, and means on said first cover defining a lip at said inside diameter thereof engaging said inside diameter of said first annular flange on said rim, and said means rigidly attaching said second cover to said rim includes a second annular flange on said rim generally in the plane of said second one of said pair of annular side walls and extending radially in from said rim to an inside diameter, and means on said cover defining a lip at said inside diameter thereof engaging said inside diameter of said second annular flange on said rim.

7. In a turbomachine rotor including a disc;

means defining an annular rim on said disc having a cylindrical outside wall between a pair of annular side walls, means defining a plurality of blade retaining slots in said rim opening through said outside wall and through each of said side walls, and a plurality of blades each having a root captured radially in one of said retaining slots between said side walls and an airfoil extending radially out from said cylindrical outside wall, the combination comprising:

a ring disposed around said rim including a cylindrical platform concentric with said cylindrical outside wall, means defining a plurality of airfoil-shaped slots in said platform each receiving a corresponding one of said blade airfoils, means defining a first annular flange extending radially in from a first edge of said platform, means defining a second annular flange extending radially in from a second edge of said platform, means defining on said first annular flange a first lip having a radially outwardly exposed surface generally at the inside diameter of said first annular flange, means on said rim defining a first radially inwardly facing cylindrical surface engaging said first lip on said radially outwardly exposed surface thereof for reacting rotation-induced loads from said ring to said rim, means on said second annular flange defining a second lip between the planes of said first and said second annular flanges having slots therein at locations in register with said blade retaining slots on said rim, means on said second lip defining a second radially outwardly exposed surface having slots therein at locations in register with said slots in said second lip, means on said rim defining a third lip between the planes of said pair of side walls having slots therein at locations in register with said blade retaining slots, and means on said third lip on said rim defining a second radially inward facing surface having slots therein at locations in register with said slots in said third lip and engaging said second outwardly exposed surface on said second lip.

* * * * *